US005344013A

United States Patent [19]

Born et al.

[11] Patent Number: 5,344,013

[45] Date of Patent: Sep. 6, 1994

[54] END WALL MADE OF MATERIAL WHICH CAN BE SHAPED WITHOUT CUTTING FOR A WINDING FILM

[75] Inventors: Norbert Born, Blieskastel; Wolfgang Oberhausen, Mainz-Ebersheim, both of Fed. Rep. of Germany

[73] Assignee: Hoechst Aktiengesellschaft, Frankfurt am Main, Fed. Rep. of Germany

[21] Appl. No.: 949,224

[22] Filed: Sep. 23, 1992

[30] Foreign Application Priority Data

Sep. 28, 1991 [DE] Fed. Rep. of Germany ..... 4132442

[51] Int. Cl.[5] ..... B65D 85/671

[52] U.S. Cl. ..... 206/391; 206/416

[58] Field of Search ..... 206/389, 391, 397, 413, 206/414–416, 386, 509, 511

[56] References Cited

U.S. PATENT DOCUMENTS

| | | | |
|---|---|---|---|
| 4,058,216 | 11/1977 | Tsuyuguchi | 206/416 |
| 4,253,570 | 3/1981 | O'Connor et al. | 206/391 |
| 4,877,133 | 10/1989 | Klenter et al. | 206/416 |
| 4,884,690 | 12/1989 | Klenter et al. | 206/416 |
| 5,096,063 | 3/1992 | Schreiter | 206/391 |
| 5,100,076 | 3/1992 | Cobane et al. | 206/416 |
| 5,205,411 | 4/1993 | Born et al. | 206/416 |

FOREIGN PATENT DOCUMENTS

| | | |
|---|---|---|
| 0447737 | 9/1991 | European Pat. Off. . |
| 1991976 | 5/1968 | Fed. Rep. of Germany . |
| 1486562 | 3/1969 | Fed. Rep. of Germany . |
| 3808064 | 3/1989 | Fed. Rep. of Germany . |
| 2231136 | 12/1974 | France . |
| 1497929 | 1/1978 | United Kingdom . |

*Primary Examiner*—Jimmy G. Foster
*Attorney, Agent, or Firm*—Foley & Lardner

[57] ABSTRACT

An end wall having a front side which forms a flat surface while the rear side is reinforced by radial ribs and annular ribs. The radial ribs are reinforced by webs which are disposed within the ribs. A central push-in peg and locking bosses are located on the front side of the end wall. Corner surfaces of the end wall are rounded and are adjoined with the cylindrical locking bosses which have the same radius as the rounded corner surfaces. Three side walls of the end wall are equipped with stacking bosses limiting stacking pockets which have a shape complementary to that of the stacking bosses. At least the fourth side wall of the end wall has a grooving and, when a winding roll is packaged by use of the end walls, rests on a pallet. When vertically aligned end walls are stacked together laterally and/or stacked above one another vertically, the stacking bosses and stacking pockets of a side wall are mutually engaged without a gap to the complementary stacking pockets and stacking bosses of the side wall of a further end wall.

20 Claims, 3 Drawing Sheets

END WALL MADE OF MATERIAL WHICH CAN BE SHAPED WITHOUT CUTTING FOR A WINDING FILM

BACKGROUND OF THE INVENTION

The present invention relates to an end wall for a winding roll which is rectangular, and preferably square with rounded corner surfaces. The end wall typically is comprised of a material which can be shaped without cutting. The front side of the end wall facing the winding roll forms a smooth, flat surface, and comprises a central push-in peg and locking bosses. The rear side of the end wall points outward away from the winding roll and is reinforced by radial and annular ribs. The end wall further comprises stacking bosses, which limit stacking pockets, on side walls which are at right angles to the front side and rear side. The stacking pockets have a shape complementary to that of the stacking bosses so that, during lateral stacking together, the stacking bosses and stacking pockets of one side wall can mutually engage without a gap with the stacking pockets and stacking bosses of one of the side walls of a further end wall.

An end wall of this type is known from U.S Pat. No. 4,884,690. An individual one-part end wall of this type can be made of plastic or of another material which can be shaped without cutting, for the packaging of winding material, (i.e. plastic films). The winding material is wound on wind-on tubes and the end wall forms, together with a second corresponding end wall, a dimensionally stable complete packaging of a winding roll.

From the known end wall described above, a number of vertically aligned end walls of ready-packaged winding rolls can be stacked with their side walls next to one another or above one another, as desired, and can be locked in engagement with one another or mutually. This means that winding rolls, ready-packaged by means of the end walls and tie-round bands, can be stacked above one another without further action. The ready-packaged winding rolls are conventionally stacked on wooden pallets. The end-wall side wall resting on the pallet has minimal frictional connection with the pallet, on account of the smooth surfaces of the bearing surfaces of the stacking bosses, and therefore the slip resistance of a stack of this type is not guaranteed. In particular, if heavy winding rolls having such end walls are packaged, in view of the small bearing surfaces of the stacking bosses on the pallet and the accompanying high specific surface pressure of the high surface load on the stacking bosses, there is an increased danger of breakage and a lack of stability of the side wall resting thereon.

German utility model 1,991,976 discloses a one-part end wall made of plastic, which consists of a four-cornered, preferably square, flat plate reinforced by radial webs. In the center is located a push-in peg for the winding-material roll and which is equipped, for example, with holding prisms. The plate is sheathed with a strap, on the outside of which small prism-shaped strips are arranged. The strap encloses, at the corners of the plate, four cup-shaped depressions, projecting into the free hollow space between the winding material and the packaging shell and open toward the outer end surface, and possesses a circumferential stop strip which is equipped with teeth.

German Offenlegungsschrift 1,486,562 discloses a protective packaging for film and metal rolls, which consists of two identical flanges equipped with a hollow hub which can be pushed into the winding core of the roll. Each of these flanges has at least two outer edges or edge parts which are beaded over parallel to one another and which are equipped with indentations and tongues. Thus, mutual engagement of the flange edges lying above one another is achieved during the packing of a plurality of rolls on one another, and mutual displacement of the stacked-up rolls is prevented. These flanges can, by means of their side walls, be stacked next to one another or above one another and brought into engagement only in a specific relative arrangement.

Square end walls for winding rolls are described in GB Patent Specification 1,497,929, which also discloses flanges present at right angles to the end wall and along each side edge of an end wall. One of the four circumferential flanges has two projecting pegs, whereas the opposite flange possesses two holes at the locations which correspond to the locations of the pegs. The stacking of the winding rolls takes place in rows, the upper row of winding rolls being offset with their end walls relative to the lower roll, in such a way that the pegs of one end wall are in engagement with the holes of two adjacent end walls located underneath. The result is that lateral displacement of the two rows of winding rolls relative to one another is prevented.

In the end walls described in the prior art, it is considered a disadvantage that, although the end walls without a winding roll can be stacked above one another with further horizontally aligned end walls, the vertically aligned end walls, especially with the winding rolls, can be stacked next to one another or above one another and brought into engagement with one another only in a specific relative arrangement because of the arrangement of their side walls. The result is that ready-packaged winding rolls cannot be closely stacked above one another in a simple and reliable way without further manipulation.

SUMMARY OF THE INVENTION

An object of the present invention is to provide an end wall so that simple, reliable and slip-resistant stacking of winding rolls, packaged by means of such end walls on pallets, can be achieved.

Another object of the present invention is to increase the strength of the end walls to permit stacking without the breakage of the end walls.

Another object of the present invention is to provide an end wall which permits mutual engagement of the side walls when stacked adjacent to one another.

Another object of the present invention is to provide a method of stacking winding rolls without reliance on a specific relative arrangement of each winding roll.

These and other objects of the present invention can be achieved by providing a rectangular, and preferably square, end wall with rounded corner surfaces for a winding roll comprised of a material which can be shaped without cutting. The front side of the end wall facing the winding roll forms a smooth, flat surface, and comprises a central push-in peg and locking bosses which extend forward and perpendicular to the smooth, flat surface. The rear side of the end wall is reinforced by radial and annular ribs where the radial ribs comprise reinforcing webs.

The end wall further comprises side walls comprising at least two pair of stacking bosses having sloping surfaces and extending perpendicular to the front and rear sides. The side walls further comprise at least two pairs of stacking pockets which have a shape complimentary to that of the stacking bosses, so that during lateral stacking together, the stacking bosses and stacking pockets of one side wall can mutually engage without a gap with the respective stacking pockets and stacking bosses of one of the side walls of a further end wall. At least one side wall of the end wall has, instead of stacking pockets and stacking bosses, a grooving which extends over the length of the side wall and which is interrupted lengthwise by guide slots in the side wall.

In another embodiment of the present invention, two mutually opposing side walls of the end wall have a grooving. This applies particularly to large-size end walls of packaged winding rolls which are stacked next to one another, but not above one another. In this embodiment, each of the grooved side walls rests on a pallet or is in contact with a pallet located above it.

In another embodiment of the present invention, the locking bosses are located on the rounded corner surfaces of the end wall and have substantially the same radius as the rounded corner surfaces, each locking boss having a cylindrical boss extension set off by a shoulder. The boss extensions of the locking bosses of one end wall engage, when horizontally aligned end walls are stacked above one another, into recesses on the rear side of the end wall located above it. The recesses adjoin the hollow-cylindrical locking bosses and are enclosed by the rounded corner surfaces and rounded webs.

In another embodiment of the present invention, the end wall is strengthened and reinforced by webs which are disposed in the surface of the radial ribs of the rear side and which extend at right angles to the front side and the rear side. In accordance with another embodiment of the present invention, the end wall is strengthened and reinforced by webs which extend at right angles to the front side and the rear side, and are disposed in the surface of the rounded webs which enclose the recesses on the rear side of the end wall. In both of these embodiments, the reinforcing webs have a diameter which is larger than the wall thickness of the radial rib or rounded web.

In another embodiment of the present invention, the winding rolls may be stacked either upon one another or next to one another by a method which comprises first placing an end wall of the invention on each end of a winding roll so that the side wall which comprises the grooving of each of the end walls faces the same direction. This process is repeated for each winding roll, and the winding rolls then can be stacked upon one another or next to one another simply by placing the end walls adjacent one another to mutually engage the respective stacking bosses and stacking pockets. The process is repeated until the pallet is fully stacked.

Advantages of the present invention are that the grooving guarantees a firm hold on the packaged winding roll on the pallet, and that the load on the end-wall side wall resting on the pallet is distributed uniformly over the entire length of the side wall. Because of the additional strengthening of the rear side of the end wall by additional webs coupled with the fact that the load on the end wall is uniformly distributed, the danger that the side wall will break is prevented. The bevelled side surfaces of the stacking bosses and stacking pockets also permit easy stacking and unstacking of the rolls packaged by these end walls. These and other advantages of the present ivention can be readily seen by those skilled in the art upon review of the following description of preferred embodiments of the invention.

DETAILED DESCRIPTION OF THE PREFERRED EMBODIMENTS

The invention is described in detail through a graphically represented exemplary embodiment.

Figure 1:
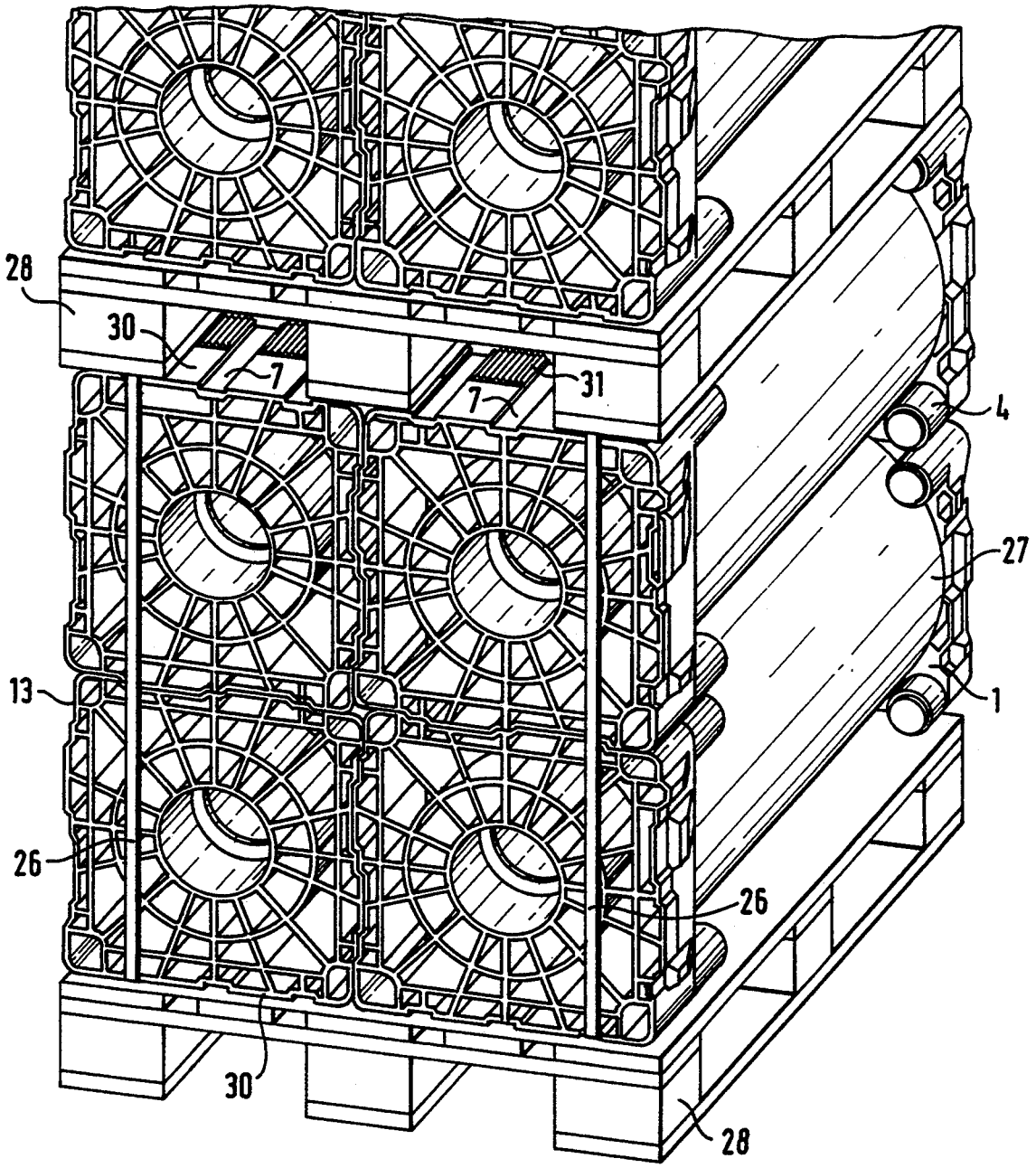
FIG. 1 illustrates in perspective a plurality of winding rolls which are packaged by end walls and which are stacked on pallets.

FIG. 1 illustrates, in perspective, winding rolls 27 which are wound onto respective wind-on tubes which are not shown. The end surfaces of the winding rolls 27 are limited by end walls 1, each of which has a central push-in peg which is pushed into the bore of the wind-on tube. The side wall 30 of each end wall 1 which is in contact with a pallet 28, on which the winding rolls 27 are stacked, has a grooving 31 which is interrupted by guide slots 7, but which otherwise extends over the length of the side wall 30. The grooving 31 preferably covers approximately half the width of the side wall 30 (See FIGS. 2 and 3), but may extend over the entire width.

Each individual groove is in the shape of a prism cut in the diagonal plane, the cross section of the grooves being triangular relative to the longitudinal direction, and the diagonal plane being the base surface of the half-prism. The grooving increases the frictional connection with the pallet preventing the packaged winding roll from slipping in any direction parallel and transversely to the longitudinal direction. To prevent slipping transversely to the longitudinal direction of the grooving, the end surface located opposite the edge of the side wall 30, of each individual groove extends at right angles, (not bevelled), to the longitudinal direction of the grooving. When the grooves are indented in a wooden plate, there are obtained, perpendicular to the longitudinal direction of the grooves, small triangular surfaces which prevent slipping in the longitudinal direction away from the edge of the side wall. The end surfaces of the grooves located opposite these triangular surfaces, at the edge of the side wall 30, form a continuous sharp-edged transverse web 34 which is interrupted only by the guide slots 7 and which prevents slipping in the longitudinal direction of the edge of the side wall.

As a result of the grooving 31, which may be anywhere from about 1 to about 6 mm high, the individual winding roll 27 is safeguarded against slipping on the pallet 28 and, the load exerted on the side wall resting thereon by the weight of the winding roll, is distributed uniformly over the length of the side wall. The danger that the side wall resting thereon will break is thereby reduced because in respect of the effective contact surface between the end wall and pallet, there no longer occurs such a high load as in the case where the side wall resting thereon comprises stacking bosses and stacking pockets and is in contact with the pallet only through the small bearing surfaces of the stacking bosses.

During stacking of pallet units of packaged winding rolls above one another, a high specific surface pressure can be produced by the pallet placed on top as a result of the small bearing surfaces of the stacking bosses. However, slipping and the danger of breakage are prevented by the grooved side wall 30 which is strengthened on the rear side by radial and annular ribs and by webs and which, instead of the side wall equipped with stacking pockets and stacking bosses, serves as a support for the upper pallet.

Figure 2:
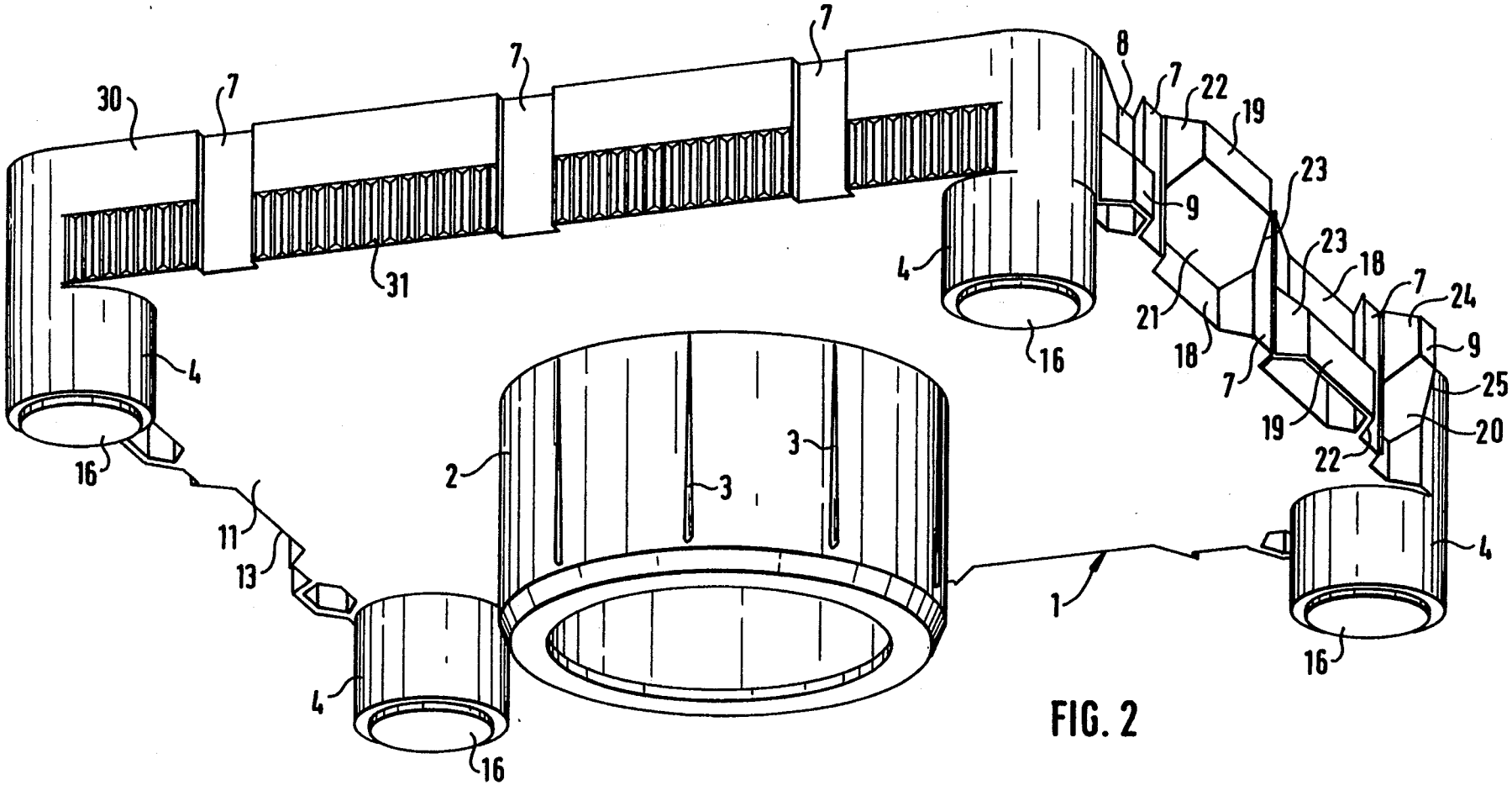
FIG. 2 illustrates a perspective view of the front side of an end wall according to the invention.

As illustrated in FIG. 2, end wall 1 is comprised of a rectangular, preferably square, front side 11, at the four corners of which are arranged locking bosses 4 which have boss extensions 16. On three side walls 13 of an end wall 1, there are stacking bosses 9 and 19 which have different lengths and different cross-sections, whereas the fourth side wall 30 is equipped with grooving 31.

Figure 3:
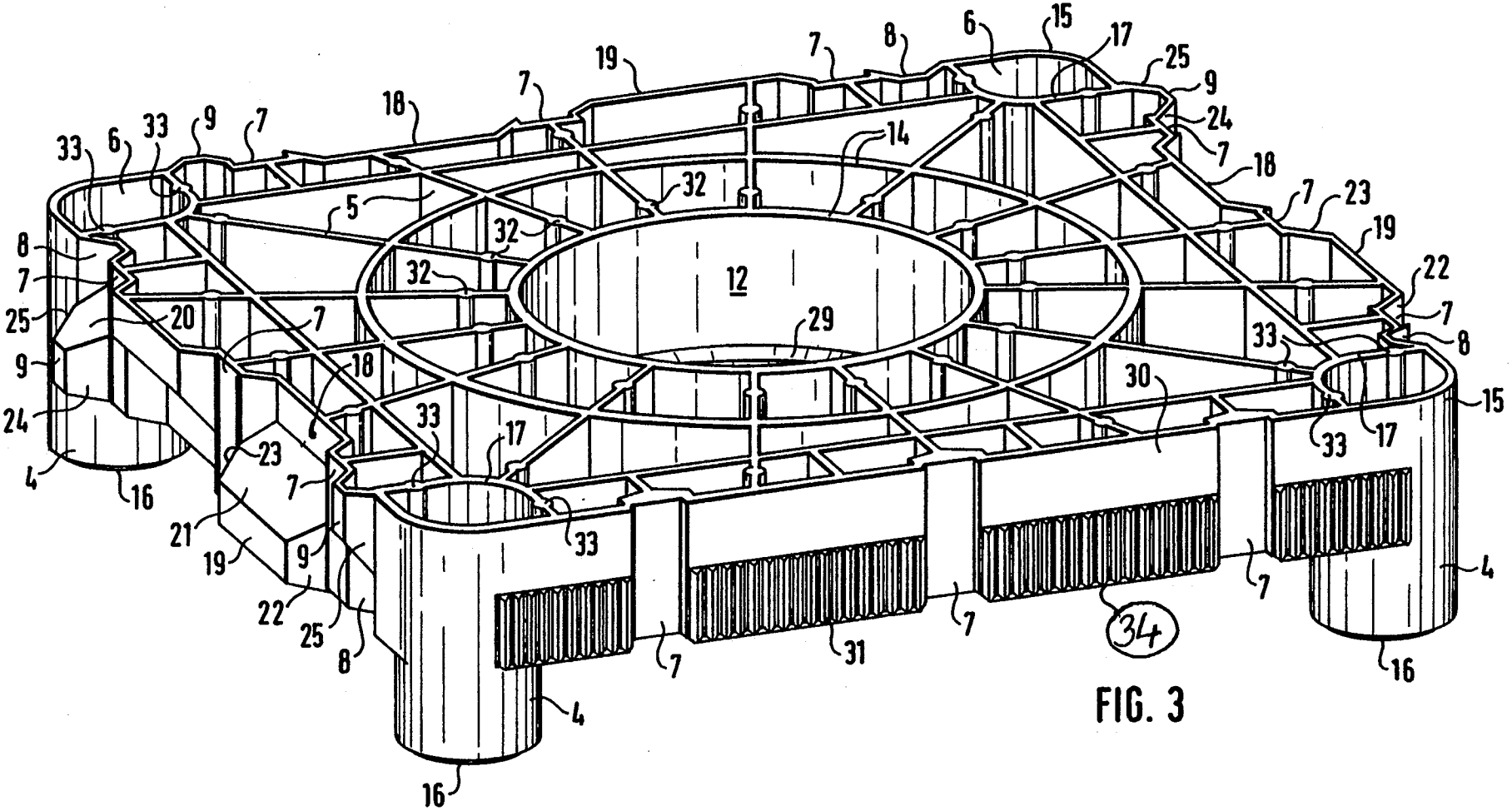
FIG. 3 illustrates a perspective view of the rear side of an end wall according to the invention.

As can be seen from the perspective view of the end wall 1 in FIG. 3, rounded corner surfaces 15 of end wall 1 are rounded and the cylindrical locking bosses 4 are integrated with these corner surfaces and have substantially the same radius as the rounded corner surfaces 15. The cylindrical boss extensions 16 are set off relative to the locking bosses 4 by a shoulder and have a smaller diameter than the locking bosses. The smooth or flat front side 11 facing the winding roll and the rounded surface of locking busses 4 protect the end surface of the winding roll against damage, especially during transportation.

V-shaped webs 3 extend on the outer surface of the central push-in peg 2 parallel to the longitudinal axis of the push-in peg, and have a cross section decreasing toward the smooth or flat front side 11. Push-in peg 2 is pressed into the bore of the wind-on tube of the winding roll. The V-shaped webs 3 on the push-in peg 2 guarantee better retention of the push-in peg in the wind-on tube and compensate for dimensional tolerances of the wind-on tube on the one hand and of the push-in peg on the other hand The diameter of the hollow-cylindrical push-in peg 2 is matched to the diameter of the respective bore of the wind-on tube.

The perspective view in FIG. 3 of the rear side of end wall 1, which faces outward and away from the winding roll, illustrates radial ribs 5 and annular ribs 14 which reinforce the rear side and which thereby avoid excessively large wall thicknesses. Thus, the unit weight of end wall 1 can be kept low. The radial and annular ribs afford a high load-bearing capacity of the end wall 1 while at the same time ensuring a low intrinsic weight. Radial ribs 5 are additionally strengthened and reinforced by reinforcing webs 32 which extend at right angles to the front side 11, and are disposed in the surface of radial ribs 5. These cylindrical reinforcing webs 32 have a diameter which is larger than the wall thickness of radial ribs 5.

As seen from FIGS. 2 and 3, stacking bosses 9 and 19 limit stacking pockets 8 and 18 which are made complementary to the stacking bosses. The stacking bosses 9 typically are smaller than the stacking bosses 19. The basic body shape of the two pairs of stacking bosses 9 and 19 is respectively cuboid with one side surface 20 and 21 of the stacking boss 9 and 19, respectively, being bevelled and inclined toward side wall 13. One stacking boss 9 is arranged near each of the two corner surfaces 15 of a side wall 13, one stacking boss 9 being rotated through 180° relative to the other stacking boss 9. The other pair of stacking bosses 19 of one side wall 13 are likewise rotated through 180° relative to one another and offset diagonally relative to one another. A stacking boss 9 or 19 is respectively aligned, for example, with the lower edge of side wall 13, while the respective stacking boss 19 or 9 rotated through 180° thereto is aligned with the upper edge of side wall 13.

The longer stacking boss 19 also possesses sloping surfaces 22 and 23 in addition to the bevelled side surface 21. The pair of stacking bosses 19 rotated through 180° relative to one another and located diagonally opposite one another are arranged so that sloping surfaces 22 and 23, located diagonally opposite one another, overlap. The surfaces 21, 22 and 23 form a stacking boss 19 which is tapered in the shape of a truncated pyramid. The group of shorter stacking bosses 9 likewise possesses sloping surfaces 24 and 25 for each stacking boss. The sloping surfaces 22 and 24, and 23 and 23, located at a distance opposite one another and belonging to the stacking bosses 9 and 19, respectively, form the limiting walls for a guide slot 7 which receives a tie-round band 26 (cf. FIG. 1) for winding roll 27.

Located in each of side wall 13 and 30 are at least two guide slots 7 which may be, for purpose of illustration and not limitation, about 20 mm wide and about 10 mm deep. Guide slots 7 extend perpendicular relative to the longitudinal edge of respective side wall 13 and side wall 30. Three guide slots 7 are present in the embodiment illustrated in FIGS. 2 and 3, the guide slots being inwardly recessed with respect to the adjacent grooving 31.

The two end walls of a winding roll are connected firmly to the wind-up roll by being tied with two or three tie-round bands 26 made of plastic or metal. The exact spacing of the guide slots 7 from one another typically is selected so that the tie-round bands can be attached by means of a tandem tie-round installation. Skilled practitioners are capable of selecting the spacing of guide slots 7 to permit a tandem tie-round installation. Furthermore, the end-wall edges can be reinforced at the tie-round points and the guide slots acquire the corresponding strength by means of an opposite end-wall rib.

Radial ribs 5 and annular ribs 14 of the rear side of end wall 1 are located at the same height as the outer edge or the rim of side walls 13 and 30. In the exemplary embodiment described, two stacking bosses 9 and two stacking bosses 19 are provided respectively for each side wall 13. This number of stacking bosses is sufficient, for purposes of illustration only and not limitation, for dimensions of end wall 1 of 485×505 mm. Skilled practitioners readily recognize that, if the end wall has larger dimensions, such as, 585×605 mm or 680×700 mm, more stacking bosses 9 and 19 may be present for each side wall. The number of guide slots 7 also may be larger than three if end wall 1 has larger dimensions.

As can be seen from FIG. 3, the rear side of end wall 1 has a central cylindrical passage orifice 12. The hollow-cylindrical push-in peg 2 is connected to this central passage orifice through a shoulder 29. The diameter of the passage orifice 12 is larger than the external diameter of the push-in peg 2. Also located on the rear side of end wall 1 are recesses 6 which are enclosed by rounded corner surfaces 15 and rounded webs 17. Recesses 6 adjoin the rear side of the hollow-cylindrical locking bosses 4. Rounded webs 17 are reinforced further by reinforcing webs 33 which extend at right angles to the front side of end wall 1. These cylindrical reinforcing webs 33 also have a diameter which is larger than the wall thickness of rounded webs 17.

If two horizontally aligned end walls 1 are stacked one above the other, the boss extensions 16 of the locking bosses 4 of one end wall engage into the recess 6 on the rear side of the end wall located above it. The push-in peg likewise engages in the passage orifice 12, thereby affording the possibility of stacking and palletizing the end walls in a space-saving manner.

The stacking bosses and stacking pockets engage in one another in such a manner that displacement along or at right angles to the side wall 13 is prevented. The bevelled side surfaces 20 and 21 and sloping surfaces 22, 23 and 24 of the stacking bosses and the stacking pockets permit easy stacking and unstacking of winding rolls 27 packaged by these end walls. Interlocking of the complete winding rolls stacked on or next to one another and packaged by end walls 1 is achieved.

End walls 1 may be manufactured as a unitary article from, for example, thermoplastics by the injection-molding process. Regenerates and recycling materials also can be used for this. Both the stacking bosses and the webs and ribs are shaped in the same injection-molding operation.

In the exemplary embodiment shown, because three side walls 13 of the end wall are made identical in respect of the stacking bosses and stacking pockets, lateral stacking next to one another and/or stacking above one another of the winding rolls closed off by the end walls is possible at any time. The side wall of one end wall can be brought into engagement with the side wall of a further end wall without a preferred alignment of the end walls relative to one another being necessary. Therefore, the stacking bosses and stacking pockets engage or catch in one another in any position of the end walls, whether aligned vertically or horizontally. It is necessary only to ensure that side wall 30 rests on the pallet 28 or comes into contact with the underside of a pallet which is placed onto a finished stack of, for example, four packaged winding rolls. It also is possible that individual, vertically aligned end walls can easily be transported on roller conveyors having a roller spacing of about 60 to about 80 mm, since the stacking bosses 9 or 19 of individual side wall 13 lie with their top surfaces in the same plane and are spaced from one another by a maximum of about 20 mm.

In another embodiment not shown, two mutually opposing side walls 30 of the end wall 1 have a grooving 31, while the other two opposing side walls 13 of the end wall 1 comprise at least two pairs of stacking pockets 8, 18 and two pairs of stacking bosses 9, 19.

The foregoing description is based upon a preferred embodiment of the invention and is not intended to limit the scope of the invention. It is to be understood that modifications and variations may be made to the invention without departing from the spirit and scope thereof, and that any such modifications and variations are within the purview of the appended claims.

What is claimed is:

1. An end wall for a winding roll made of a material shapable without cutting, said end wall being generally rectangular with rounded corners and comprising:

(a) a front side facing the winding roll which forms a flat surface, said front side including
a central push-in peg; and
hollow cylindrical locking bosses located on said rounded corners and having substantially the same radius as said rounded corners wherein said locking bosses further include a boss extension and a shoulder;

(b) a rear side facing away from the winding roll and reinforced by radial and annular ribs, said radial ribs including reinforcing webs disposed in the radial ribs, said rear side further having recesses defined by said rounded corners and by rounded webs wherein said rounded webs have cylindrical reinforcing webs disposed therein, said cylindrical reinforcing webs having a diameter larger than a thickness of said radial ribs and larger than a thickness of said rounded webs, said reinforcing webs of said rounded webs and said radial ribs extending at right angles to said front side, wherein said recesses adjoin said hollow-cylindrical locking bosses;

(c) a plurality of first side walls located between said front and rear sides, each of said first side walls including:
a plurality of stacking bosses; and
a plurality of stacking pockets, wherein said stacking bosses are complementary in shape to said stacking pockets for providing mutual engagement without a gap of the stacking bosses and stacking pockets during lateral stacking of a plurality of end walls; and (d) at least one second side wall located between said front and rear sides, each said second side wall including grooving extending over a portion of the length of said second side wall interrupted by guide slots that are inwardly recessed with respect to said grooving.

2. The end wall as claimed in claim 1, wherein two mutually opposing second side walls include the grooving.

3. The end wall as claimed in claim 1, wherein said boss extensions engage, when horizontally aligned end walls are stacked above one another, into recesses on a rear side of an end wall located above it.

4. The end wall as claimed in claim 1, wherein said stacking bosses have bevelled side surfaces inclined toward said side wall and sloping surfaces inclined toward said side wall, and wherein said plurality of stacking bosses are aligned in at least two pairs on said side wall.

5. The end wall as claimed in claim 4, wherein at least one pair of said stacking bosses has a larger length and larger cross-section than at least one of the other pair of stacking bosses;

one of a pair of stacking bosses being arranged near one end of said side wall and the other of said pair of stacking bosses being rotated through 180°, off-set diagonally thereto and arranged near the other end of said side wall; and at least one of the other pair of stacking bosses are rotated through 180° and off-set diagonally relative to one another with an overlap of said sloping surfaces.

6. The end wall as claimed in claim 5, wherein guide slots are disposed between adjacent stacking bosses, said guide slots extending perpendicular relative to a longitudinal edge of said first side wall.

7. The end wall as claimed in claim 1, wherein said central push-in peg is connected through a shoulder to a central cylindrical passage orifice on said rear side and is hollow, and wherein the diameter of said central cylindrical passage orifice is larger than the external diameter of said central push-in peg.

8. The end wall as claimed in claim 1, wherein V-shaped webs extend parallel to the longitudinal axis and on the outer surface of said central push-in peg, said V-shaped webs having a cross-section decreasing toward said front side of said end wall.

9. The end wall as claimed in claim 1, wherein said grooving includes a plurality of grooves, each groove being in the shape of a prism cut in a diagonal plane, the cross-section of said groove being triangular and the diagonal plane forming a base surface of a half-prism.

10. The end wall as claimed in claim 9, wherein a triangular end surface of each of said plurality of grooves is disposed opposite the edge of said second side wall and extends at right angles to the longitudinal direction of said grooving.

11. The end wall as claimed in claim 10, wherein an end surface of each of said plurality of grooves is disposed opposite said triangular end surface and forms a continuous sharp-edged transverse web interrupted by said guide slots.

12. The end wall as claimed in claim 1, wherein said end wall has the shape of a square.

13. An end wall for a winding roll made of a material shapable without cutting, said end wall being generally rectangular with rounded corners and comprising:

(a) a front side facing the winding roll which forms a flat surface, said front side including:
a central push-in peg; and
locking bosses;

(b) a rear side facing away from the winding roll and reinforced by radial and annular ribs, said radial ribs including reinforcing webs;

(c) a plurality of first side walls located between said front and rear sides, each of said first wide walls including:
a plurality of stacking bosses; and
a plurality of stacking pockets, wherein said stacking bosses are complementary in shape to said stacking pockets for providing mutual engagement without a gap of the stacking bosses and stacking pockets during lateral stacking of a plurality of end walls; and (d) at least one second side wall located between said front and rear sides, each said second side wall including grooving extending over a portion of the length of said second side wall interrupted by guide slots that are inwardly recessed with respect to said grooving;

wherein said grooving includes a plurality of grooves, each groove being in the shape of a prism cut in a diagonal plane, the cross-section of said groove being triangular and the diagonal plane forming a base surface of a half-prism.

14. The end wall as claimed in claim 13, wherein said locking bosses are cylindrical, are located on said rounded corners, and have substantially the same radius as said rounded corners, said locking bosses further including a boss extension and a shoulder.

15. The end wall as claimed in claim 14, wherein said cylindrical locking bosses are hollow, wherein said rear side further has recesses defined by said rounded corners and by rounded webs, and wherein said recesses adjoin said hollow-cylindrical locking bosses.

16. The end wall as claimed in claim 15, wherein said rounded webs have reinforcing webs disposed therein, and the reinforcing webs of the radial ribs are disposed therein, said reinforcing webs of said rounded webs and said radial ribs extending at right angles to said front side.

17. The end wall as claimed in claim 16, wherein said reinforcing webs are cylindrical with a diameter larger than the thickness of said radial ribs, and larger than the thickness of said rounded webs.

18. The end wall as claimed in claim 17, wherein V-shaped webs extend parallel to the longitudinal axis and on the outer surface of said central push-in peg, said V-shaped webs having a cross-section decreasing toward said front side of said end wall.

19. The end wall as claimed in claim 13, wherein a triangular end surface of each of said plurality of grooves is disposed opposite the edge of said second side wall and extends at right angles to the longitudinal direction of said grooving.

20. The end wall as claimed in claim 19, wherein an end surface of each of said plurality of grooves is disposed opposite said triangular end surface and forms a continuous sharp-edged transverse web interrupted by said guide slots.

* * * * *